US009261827B2

(12) United States Patent
Kawaguchi

(10) Patent No.: US 9,261,827 B2
(45) Date of Patent: Feb. 16, 2016

(54) HEAT SOURCE UNIT

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Takahiro Kawaguchi, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/309,156

(22) Filed: Jun. 19, 2014

(65) Prior Publication Data

US 2015/0370202 A1 Dec. 24, 2015

(51) Int. Cl.
*G03G 15/20* (2006.01)

(52) U.S. Cl.
CPC ..... *G03G 15/2035* (2013.01); *G03G 15/2028* (2013.01)

(58) Field of Classification Search
CPC ..... G03G 15/2021; G03G 15/2032; G03G 15/2035; G03G 15/2067; G03G 15/2071; G03G 21/1638; G03G 2221/1639; G03G 2221/1675
USPC ..... 399/122, 124, 322
See application file for complete search history.

(56) References Cited

U.S. PATENT DOCUMENTS

| | | | |
|---|---|---|---|
| 2012/0306985 | A1 | 12/2012 | Iguchi et al. |
| 2013/0002782 | A1 | 1/2013 | Kawaguchi et al. |
| 2013/0242022 | A1 | 9/2013 | Saito |
| 2013/0267412 | A1 | 10/2013 | Kawaguchi |

FOREIGN PATENT DOCUMENTS

| | | | |
|---|---|---|---|
| JP | 59214861 | A * | 12/1984 |
| JP | 2011-033828 | | 2/2011 |

* cited by examiner

*Primary Examiner* — Erika J Villaluna
(74) *Attorney, Agent, or Firm* — Amin, Turocy & Watson, LLP

(57) ABSTRACT

In accordance with one embodiment, a heat source unit comprises a first heating section configured to include a first heating member and a first pressing member; a second heating section, which is arranged at the downstream side of the first heating section in a paper conveyance direction, configured to include a second heating member and a second pressing member; a heat source opening and closing mechanism configured to include a rotation shaft at the upstream side of the first heating section in the paper conveyance direction, and be capable of being opened and closed around the rotation shaft; and a paper conveyance guide section configured to include, between the first and the second heating sections, a first paper conveyance rib arranged at one side of the paper conveyance path and a second paper conveyance rib arranged at the other side of the paper conveyance path.

9 Claims, 7 Drawing Sheets

HEAT SOURCE UNIT

FIELD

Embodiments described herein relate generally to a heat source unit.

BACKGROUND

Conventionally, in an image forming apparatus which heats and presses the toner of an electronic photograph and the like to fix the toner on a paper, as a method for removing papers jammed in a fixing apparatus or papers stopping when passing through the fixing apparatus, a method of drawing the papers out after releasing the pressure between the press roller and the heat roller is widely used.

However, in a heat source unit in which a pair of heat rollers and a pair of press rollers are arranged in series in a reversed manner, there exists a case where the papers jammed between the heat sources deform into an accordion shape and enter the space between the paper conveyance guide and the roller, and are therefore hard to remove. Further, as the operation of removing the jammed papers is carried out nearby the heat roller having a high temperature and the press roller, there exists inconvenience for the paper removing job.

DETAILED DESCRIPTION

Figure 1:
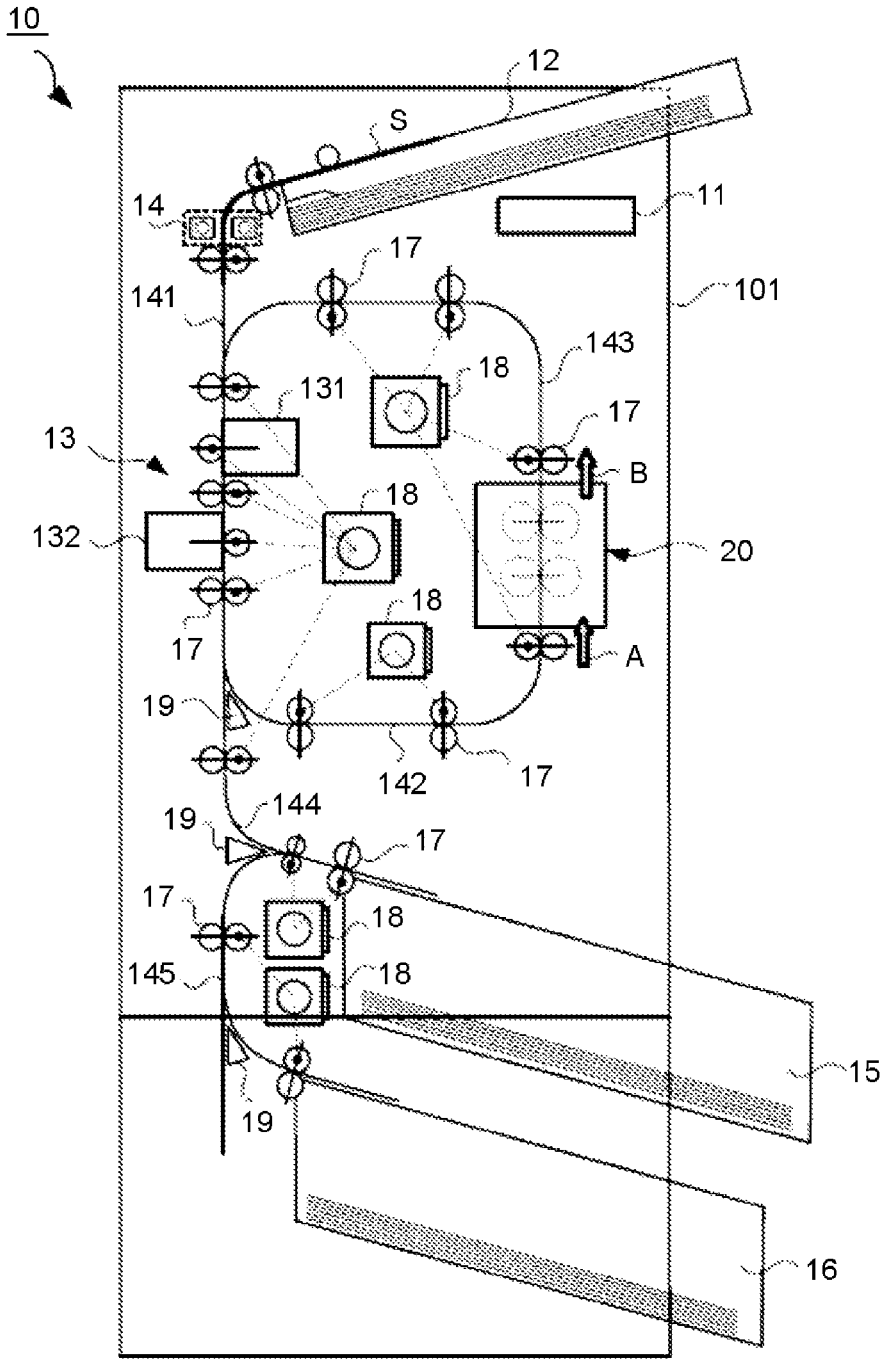
FIG. 1 is a schematic view illustrating an example of a whole constitution of a color erasing apparatus which applies a heat source unit according to an embodiment 1.

In accordance with one embodiment, a heat source unit comprises a first heating section configured to include a first heating member which heats one side of a paper and a first pressing member which is arranged opposite to the first heating member across a paper conveyance path to cooperate with the first heating member to nip and convey the paper; a second heating section, which is arranged at the downstream side of the first heating section in a paper conveyance direction, configured to include a second heating member which heats the other side of the paper and a second pressing member which is arranged opposite to the second heating member across the paper conveyance path to cooperate with the second heating member to nip and convey the paper; a heat source opening and closing mechanism configured to include a rotation shaft at the upstream side of the first heating section in the paper conveyance direction, and be capable of being opened and closed around the rotation shaft with the paper conveyance path as a boundary; and a paper conveyance guide section configured to include, between the first and the second heating sections, a first paper conveyance rib arranged at one side of the paper conveyance path and a second paper conveyance rib arranged at the other side of the paper conveyance path, at least one of which is positioned at a first position where a paper can be conveyed or a second position different from the first position by interlocking with an operation of switching the heat source opening and closing mechanism from a closed state to an opened state.

In accordance with one embodiment, a heat source unit comprises a first heating section configured to include a first heating member which heats one side of a paper and a first pressing member which is arranged opposite to the first heating member across a paper conveyance path to cooperate with the first heating member to nip and convey the paper; a second heating section, which is arranged at the downstream side of the first heating section in a paper conveyance direction, configured to include a second heating member which heats the other side of the paper and a second pressing member which is arranged opposite to the second heating member across the paper conveyance path to cooperate with the second heating member to nip and convey the paper; a heat source opening and closing mechanism configured to include a rotation shaft at the upstream side of the first heating section in the paper conveyance direction, and be capable of being opened and closed around the rotation shaft with the paper conveyance path as a boundary; and a protection member configured to be arranged at either of the second heating member and the second pressing member, and be positioned at a first position where a paper can be conveyed or a second position different from the first position for covering the member by interlocking with an operation of switching the heat source opening and closing mechanism from a closed state to an opened state.

Hereinafter, the embodiment of the present invention is described in detail with reference to the accompanying drawings.

Embodiment 1

FIG. 1 is a schematic view illustrating an example of a whole constitution of a color erasing apparatus 10 which applies a heat source unit according to the present embodiment. As shown in FIG. 1, the color erasing apparatus 10 comprises an operation panel 11 including operation buttons and a display section, a paper feed section 12, a scanner 13 serving as a reading section, an ultrasonic sensor 14 for detecting the conveyance state of a paper S and a color erasing section 20 serving as a heat source unit for erasing an image on the paper S. In addition to a first conveyance path 141, a second conveyance path 142, a third conveyance path 143, a fourth conveyance path 144 and a fifth conveyance path 145, the color erasing apparatus 10 further comprises a first paper discharge tray 15 and a second paper discharge tray 16 serving as paper discharge sections.

Each of the conveyance paths 141~145 has a plurality of conveyance rollers 17 for conveying the paper S and a plurality of motors 18 for driving each of the conveyance rollers 17. Further, each of the conveyance paths 141~145 is provided with a plurality of gates 19 for correctly conveying the paper S to each of the conveyance paths 141~145.

The first conveyance path 141 conveys the paper S from the paper feed section 12 to the scanner 13. The second conveyance path 142 conveys the paper S from the scanner 13 to the color erasing section 20 along a direction indicated by an arrow A. The third conveyance path 143 conveys the paper S from the color erasing section 20 to the scanner 13 again. The fourth conveyance path 144 conveys the paper S from the scanner 13 to the first paper discharge tray 15. The fifth conveyance path 145 conveys the paper S from the scanner 13 to the second paper discharge tray 16.

The first paper discharge tray 15 collects, for example, a reusable paper S the image on which is erased. The second paper discharge tray 16 collects a not-reusable paper S which is generally scraped and recycled.

The color erasing apparatus 10 mainly carries out the following operations (1)-(5):

(1) reading the paper S fed from the paper feed section 12 by the first conveyance path 141 using the scanner 13. The scanner 13 includes a first scanner 131 and a second scanner 132 to read two sides of the paper S. The scanner 13 reads, for example, image data before the image on the paper S is erased. Simultaneously, the scanner 13 reads the state of the paper S. 'The state of the paper' described herein refers to, for example, the concentration of printing ratio, or the fracture, crumple, rip of a paper, and the like.

(2) storing the image data read by the scanner 13. Further, according to the state of the paper S read by the scanner 13, if the paper S is ripped or crumpled, it is guided to the fifth conveyance path 145 and then conveyed to the second paper discharge tray 16. The paper S without any rip or crumple is conveyed to the color erasing section 20 by the second conveyance path 142.

(3) heating the paper S conveyed to the color erasing section 20 when it passes through the color erasing section 20 to erase the image formed on the paper S by heating. The color erasing section 20 heats and presses the paper S at a relatively high temperature of, for example, 180~200 degrees centigrade, to erase the image on the paper S. The detailed constitution of the color erasing section 20 is described later.

(4) conveying the paper S passing through the color erasing section 20 to the scanner 13 again with the third conveyance path 143. The scanner 13 reads the state of the paper S again to confirm whether or not the image formed with erasable coloring agent in an image area is actually erased.

(5) conveying the reusable paper S to the first paper discharge tray 15 with the fourth conveyance path 144. According to the state of the paper S read by the scanner 13, if there is an image formed with inerasable coloring agent or a handwritten image left in the image area of the paper S, or if the paper S is ripped or crumpled, the paper S is conveyed to the second paper discharge tray 16 by the fifth conveyance path 145.

Figure 2:
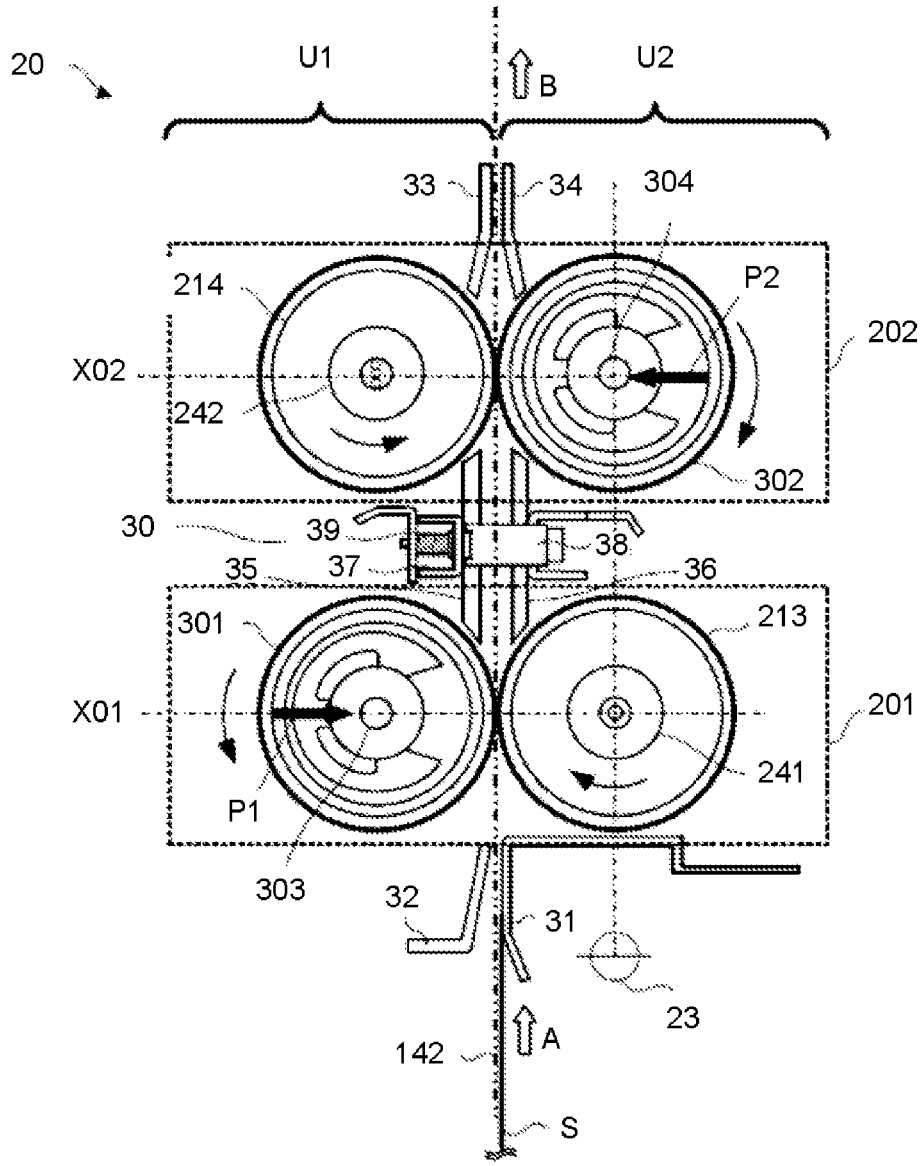
FIG. 2 is a sectional view illustrating an internal structure of the heat source unit shown in FIG. 1.

FIG. 2 is a schematic constitution diagram illustrating the internal structure of the color erasing section (heat source unit) 20. The color erasing section 20 heats the paper S fed by the paper feed section 12 with a heat source at a given heat source setting temperature while conveying the paper S on the conveyance path, so as to erase the image on the paper S. As shown in FIG. 2, the color erasing section 20 has a first color erasing section (first heating section) 201 and a second color erasing section (second heating section) 202. The first color erasing section 201 includes a first heat roller 213 serving as a heating member and a first press roller 301 serving as a pressing member. Similarly, the second color erasing section 202 includes a second heat roller 214 and a second press roller 302. Though the first color erasing section 201 is structurally identical to the second color erasing section 202, the arrangement position of the first heat roller 213 is opposite to that of the second heat roller 214 across the second conveyance path 142. The paper S is conveyed on the second conveyance path 142 from a direction indicated by an arrow A. The direction indicated by the arrow A is equivalent to the direction indicated by the arrow A in FIG. 1. The paper S passing through the color erasing section 20 is conveyed on the third conveyance path 143 to a direction indicated by an arrow B. The direction indicated by the arrow B is equivalent to the direction indicated by the arrow B in FIG. 2.

The color erasing section 20 can be divided into two units with the paper conveyance path as a boundary. When the color erasing section 20 is arranged inside the color erasing apparatus 10, an inside unit (main body unit) U1 which is positioned inside includes the first press roller 301 and the second heat roller 214. Further, an outside unit (movable unit) U2 which is positioned outside includes the first heat roller 213 and the second press roller 302.

The first heat roller 213 and the second heat roller 214 are respectively provided with cylindrical halogen heaters 241 and 242 which extend in a width direction of the paper S. The first press roller 301 and the second press roller 302 are cylindrical rotation rollers which are respectively contacted with the first heat roller 213 and the second heat roller 214 in a longitudinal direction thereof, and rotate around the rotation axes 303 and 304, respectively. The first press roller 301 and the second press roller 302 are formed by, for example, contacting a tube having mold releasability with the surface of an elastic body such as a silicon sponge and the like.

The first press roller 301 and the second press roller 302 energize the rotation axes 303 and 304 in the direction of the first heat roller 213 and the second heat roller 214 (in directions indicated by arrows P1 and P2), respectively. The paper S is nipped, pressed and heated between the first heat roller 213 and the first press roller 301, and then between the second heat roller 214 and the second press roller 302, while being conveyed.

Paper conveyance ribs 31 and 32 are arranged at a paper carry-in side of the first color erasing section 201 for guiding the conveyance of the paper S. Paper conveyance ribs 33 and 34 are arranged at a paper carry-out side of the second color erasing section for guiding the discharge of the paper S. A paper conveyance guide section 30 is arranged at the paper discharge side of the first color erasing section 201 for guiding the paper S passing through the first color erasing section 201 to the second color erasing section 202. The paper conveyance guide section 30 includes a first paper conveyance rib 35 and a second paper conveyance rib 36.

Figure 3:
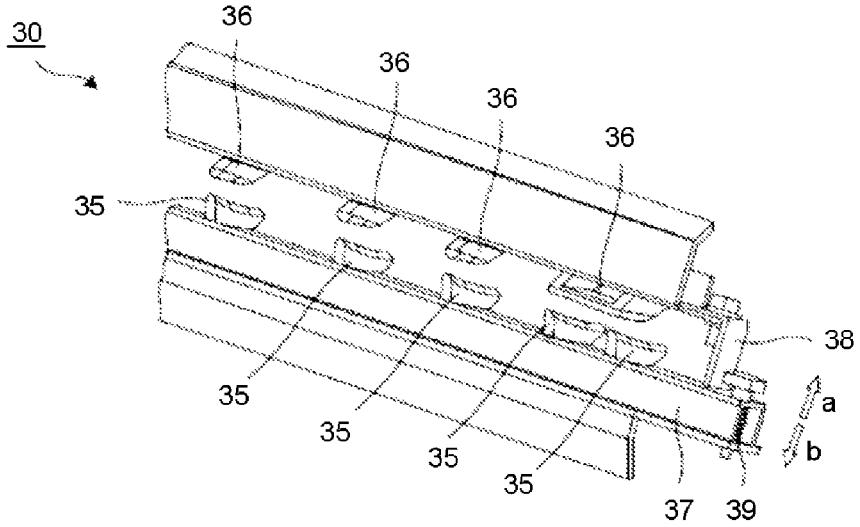
FIG. 3 is an oblique view illustrating the constitution of main portions of a paper conveyance rib arranged between a first color erasing section and a second color erasing section shown in FIG. 2.

As shown in FIG. 2 and FIG. 3, the first paper conveyance rib 35 is fixed on the inside unit U1 via a rib guide 37. The rib guide 37 is energized by an elastic member 39 such as a compression spring and the like to the direction of the second paper conveyance rib 36 (a direction indicated by an arrow a in FIG. 3). The second paper conveyance rib 36, which is arranged opposite to the paper conveyance rib 35, is fixed on the outside unit U2 together with a rib guide 38. The rib guide 38 extends in the width direction of the paper S, and two end parts of the rib guide 38 protrude in the direction of the paper conveyance path. The energization of the rib guide 37 is regulated by the contact of the two end parts of the rib guide 38 with the rib guide 37 (a direction indicated by an arrow b in FIG. 3). In a closed state, an interval required to convey the paper between the first paper conveyance rib 35 and the second paper conveyance rib 36 is maintained by contacting the rib guide 38 with the rib guide 37.

A color erasing processing carried out on the paper S by the first color erasing section 201 and the second color erasing section 202 is described below. The paper S is guided by the paper conveyance ribs 31 and 32 and conveyed to the first color erasing section 201 through the second conveyance path 142. The press roller 301 of the first color erasing section 201 and the press roller 302 of the second color erasing section 202 are rotated in opposite directions, thereby conveying the paper S in the direction indicated by the arrow A at a preset speed.

The first press roller 301 is pressed against and contacted with the first heat roller 213 through a pinch pressure P1 in the first color erasing section 201. The contact point (one dotted lines X01) of the first press roller 301 and the first heat roller 213 forms a nip area where heat is transferred to the paper S, and the surface of the paper is heated and the image formed on one side of the paper S is erased by conveying the paper S through the nip area.

In a case where the image is formed on the paper S with erasable coloring agent, the coloring agent is erased at a certain temperature. The first heat roller 213 is uniformly heated by the halogen heater 241 and maintained at a color erasing temperature. The temperature of the first heat roller 213 is detected by a thermistor (not shown), and the first heat roller 213 is maintained at a proper temperature based on the result of the temperature detection.

The paper S, after being discharged from the first color erasing section 201, is guided by the paper conveyance guide section 30 and conveyed into the second color erasing section 202. In the second color erasing section 202, the position relation of the second press roller 302 and the second heat roller 214 is opposite to that in the first color erasing section 201, and the second press roller 302 is pressed against and contacted with the second heat roller 214 through a pinch pressure P2.

The contact point (one dotted lines X02) of the second press roller 302 and the second heat roller 214 forms a nip area where heat is transferred to the paper S. The surface of the paper is heated and the image formed on the other side of the paper S is erased by conveying the paper S through the nip area. The paper S both sides of which are color erased is discharged along the paper conveyance ribs 33 and 34, and then conveyed to the third conveyance path 143.

Though the first color erasing section 201 is structurally identical to the second color erasing section 202, the arrangement position of the heat roller and press roller in the first color erasing section 201 is opposite to that in the second color erasing section 202, and each roller is arranged in series, therefore, the color of one side of the paper S is erased by the first color erasing section 201, and the color of the other side of the paper S is erased by the second color erasing section 202. Thus, the color of two sides of the paper S can be erased efficiently.

Figure 4:
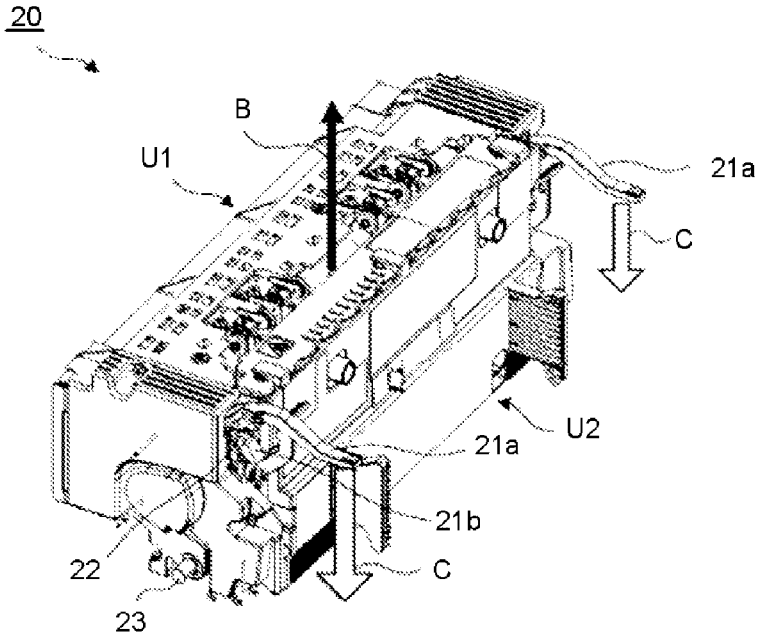
FIG. 4 is an oblique view of the heat source unit viewed from a side of an outside unit shown in FIG. 1.

The opening and closing mechanism of the color erasing section 20 is described below. As shown in FIG. 4, an opening and closing lever 21 for manually opening and closing the internal heat source is arranged at the two end parts of the inside unit U1 of the color erasing section 20. An elongated rod-like operation section 21*a* is formed on one end of the opening and closing lever 21 for an operator to grab and apply force, and a hook-shaped hook section 21*b*, which is connected with an eccentric shaft 22, is formed on the other end of the opening and closing lever 21. In the color erasing section 20 in a closed state (refer to FIG. 2), the operation section 21*a* of the opening and closing lever 21 is pressed in a direction indicated by an arrow C, the connection of the eccentric shaft 22 with the hook section 21*b* is released, therefore, the outside unit U2 rotates around a rotation shaft 23 due to its own weight, and then separates from the inside unit U1.

Figure 5:
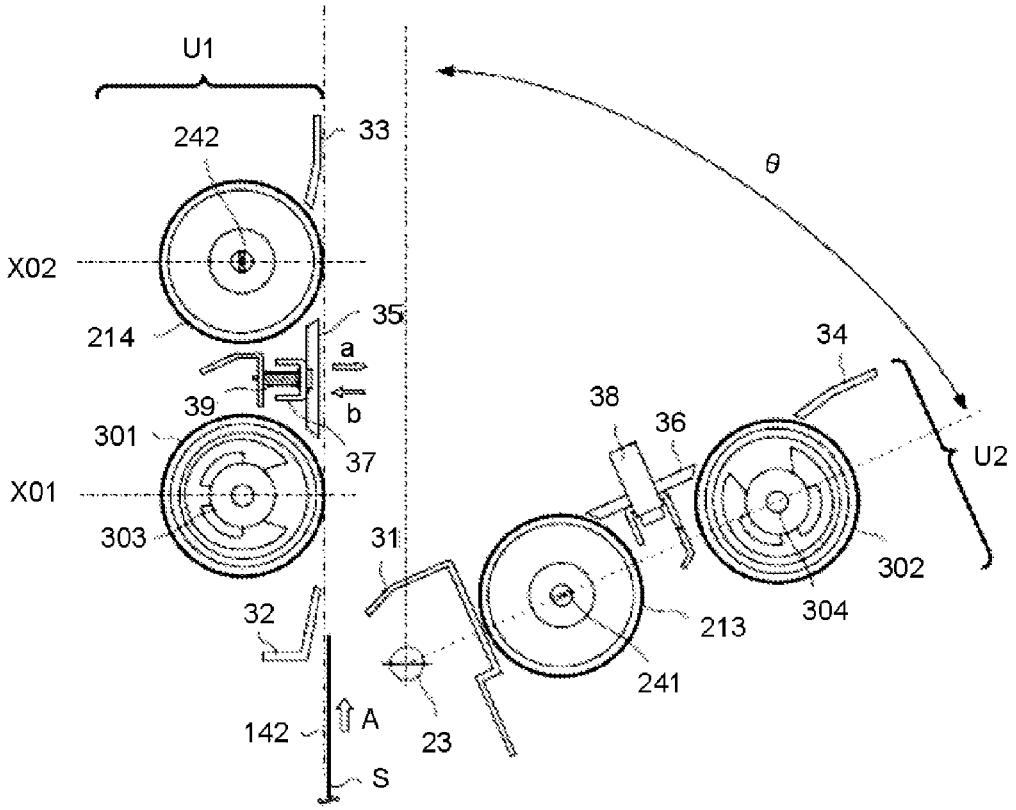
FIG. 5 is a diagram illustrating a state where the heat source unit shown in FIG. 2 is opened.

FIG. 5 is a schematic constitution diagram illustrating an opened state of the color erasing section 20 according to the embodiment 1. As shown in FIG. 5, if the outside unit U2 rotates around the rotation shaft 23 and separates from the inside unit U1, the energization of the rib guide 37 regulated by the contact of the two end parts of the rib guide 38 with the rib guide 37 is released, and the first paper conveyance rib 35 moves towards the direction of the paper conveyance path (the direction indicated by the arrow a in FIG. 3 and FIG. 5). On the other hand, in the closed state, the two end parts of the rib guide 38 press the rib guide 37 of the inside unit U1, thereby maintaining an interval for conveying the paper S and regulating the energization of the rib guide 37 (the direction indicated by the arrow b in FIG. 3 and FIG. 5). That is, the rib guide 37 is interlocked with the opening and closing operation of the heat source opening and closing mechanism, and is positioned in a state (second position) of protruding towards the paper conveyance path when the outside unit U2 is opened, and is positioned at a conveyance position (first position) for conveying the paper S when the outside unit U2 is closed. A proper interval for conveying the paper can be continuously maintained in the closed state (refer to FIG. 2). An opening angle θ of the color erasing section 20 is determined according to the range of the motion of the outside unit U2 away from the inside unit U1, and is preferred to be, for example, about 80~90 degrees.

In this way, in accordance with the color erasing section of the embodiment 1, the outside unit U2 can be separated from the inside unit U1 with the paper conveyance path as a boundary, and when the color erasing section is opened, the opening angle is large, therefore, the papers jammed in the color erasing section can be removed easily. Particularly, when paper jam occurs between the first color erasing section 201 and the second color erasing section 202, in the opened state of the color erasing section 20, the first paper conveyance rib 35 arranged between the second heat roller 214 and the first press roller 301 constituting the inside unit U1 moves towards the direction of the paper conveyance path, thereby pushing the jammed papers out, which facilitates the removing of the jammed papers.

Further, the same as the rib guide 37, the rib guide 38 may also be connected with the outside unit U2 via an elastic member such as a compression spring and the like, and energized in the direction of the paper conveyance path. According to such a constitution, in the closed state of the color erasing section 20, the energization of the rib guide 37 and the rib guide 38 is regulated mutually, and in the opened state, the mutual regulation is released, and either of the first paper conveyance rib 35 and the second paper conveyance rib 36 is positioned in a state of protruding towards the direction of the paper conveyance path.

Embodiment 2

The color erasing section according to the embodiment 2 of the present invention is described below. Reference numerals the same as those endowed in the embodiment 1 represent the same targets and therefore, the detailed descriptions thereof are not repeated, and the part different from the embodiment 1 is described in detail.

Figure 6:
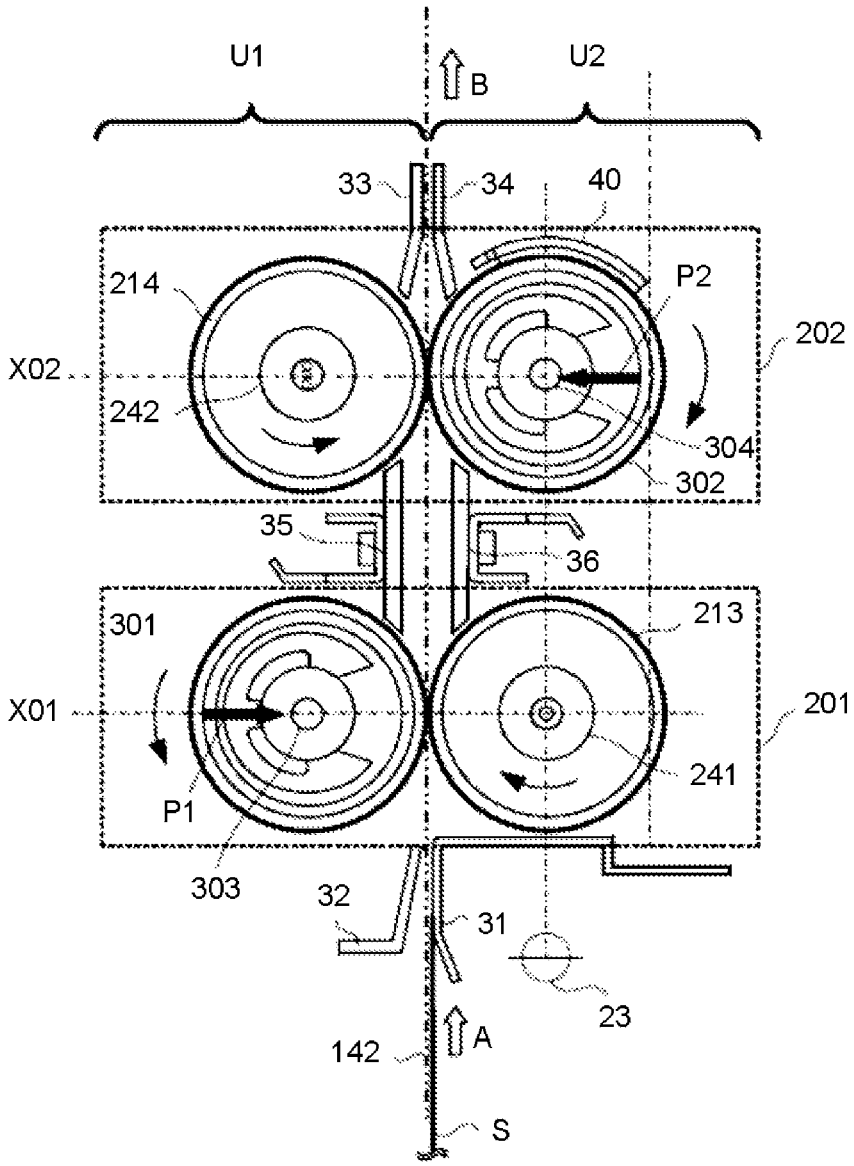
FIG. 6 is a sectional view illustrating an internal structure of a heat source unit according to an embodiment 2.
Figure 7:
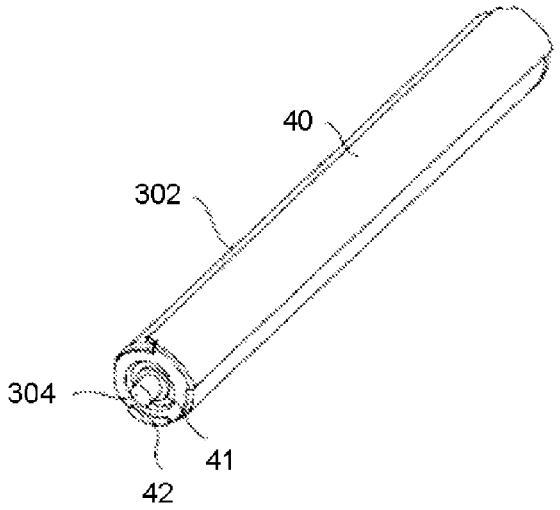
FIG. 7 is an oblique view illustrating a roller protection member shown in FIG. 6.

As shown in FIG. 6 and FIG. 7, the color erasing section 20 according to the embodiment 2 of the present invention comprises a roller protection member 40 serving as a protection member of the second press roller 302. The roller protection member 40 covers an exposed area of the second press roller in the opened state of the outside unit U2. The material of the roller protection member 40 is metal or heat-resistant resin.

As shown in FIG. 7, the roller protection member 40 extends in the longitudinal direction of the second press roller (width direction of the paper S), and the two end parts thereof are connected with a bearing 41 which is pressed into the second press roller 302. The roller protection member 40 is capable of rotating around the bearing 41. The roller protection member 40 is equipped with a weight 42 so that the position of the center of gravity is below the rotation axis 304. As the position of the center of gravity of the roller protection member 40 is below the rotation axis 304, as shown in FIG. 6, in the closed state of the color erasing section 20, the roller protection member 40 stands by at a position above the second press roller 302. In other words, the roller protection member 40 stands by at a position (first position) where no interference is brought about to the conveyance of the paper S.

Figure 8:
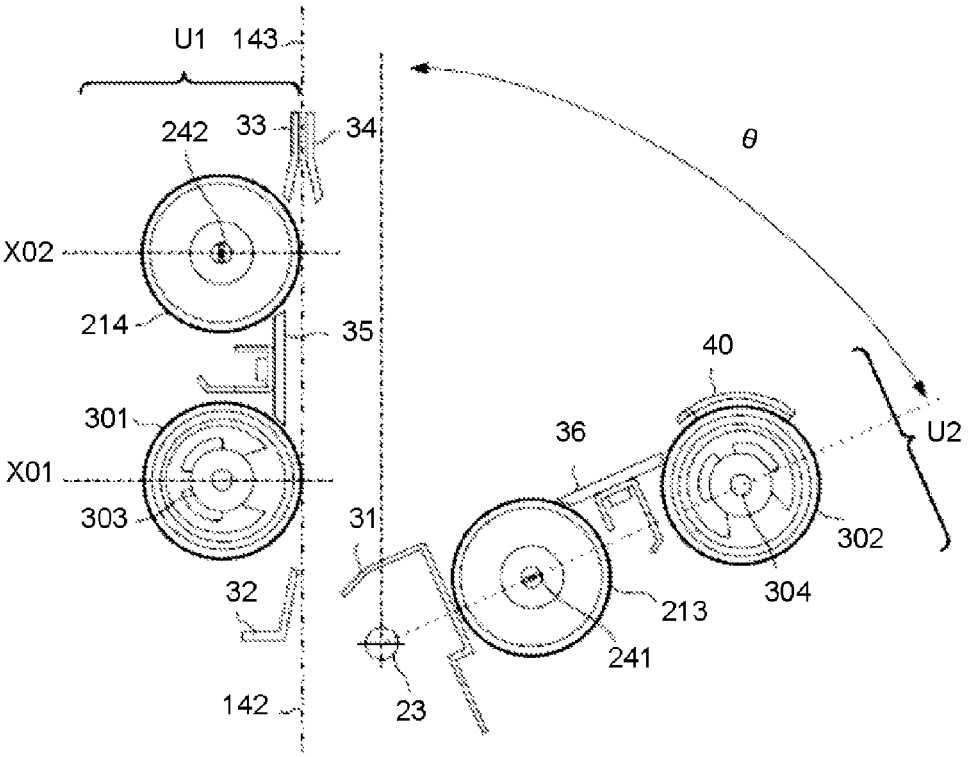
FIG. 8 is a diagram illustrating a state where the heat source unit shown in FIG. 6 is opened.

FIG. 8 is a schematic constitution diagram illustrating an opened state of the color erasing section 20 according to the embodiment 2. As shown in FIG. 8, if the outside unit U2 rotates around the rotation shaft 23 and separates from the inside unit U1, the posture of the roller protection member 40 is maintained even if the opening angle 8 of the outside unit U2 changes, meanwhile, the roller protection member 40 moves to a position (second position) to cover an area of the second press roller 302 which is exposed due to the change of the opening angle θ relatively. On the other hand, in the closed state, as stated above, the roller protection member 40 stands by at the first position where no interference is brought about to the conveyance of the paper S.

In accordance with the color erasing section of the embodiment 2, when the color erasing section is in the opened state, for the second press roller 302 which is close to the user, the roller protection member 40 moves, by its own weight, to a position to cover the exposed part of the second press roller 302. Therefore, it is possible to prevent a hand and the like of the user from contacting with the second press roller 302, and the papers jammed between the paper conveyance rib and the heating member or the pressing member which are hard to remove can be removed easily.

Embodiment 3

The color erasing section according to the embodiment 3 of the present invention is described below. Reference numerals the same as those endowed in the embodiment 1 and the embodiment 2 represent the same targets.

Figure 9:
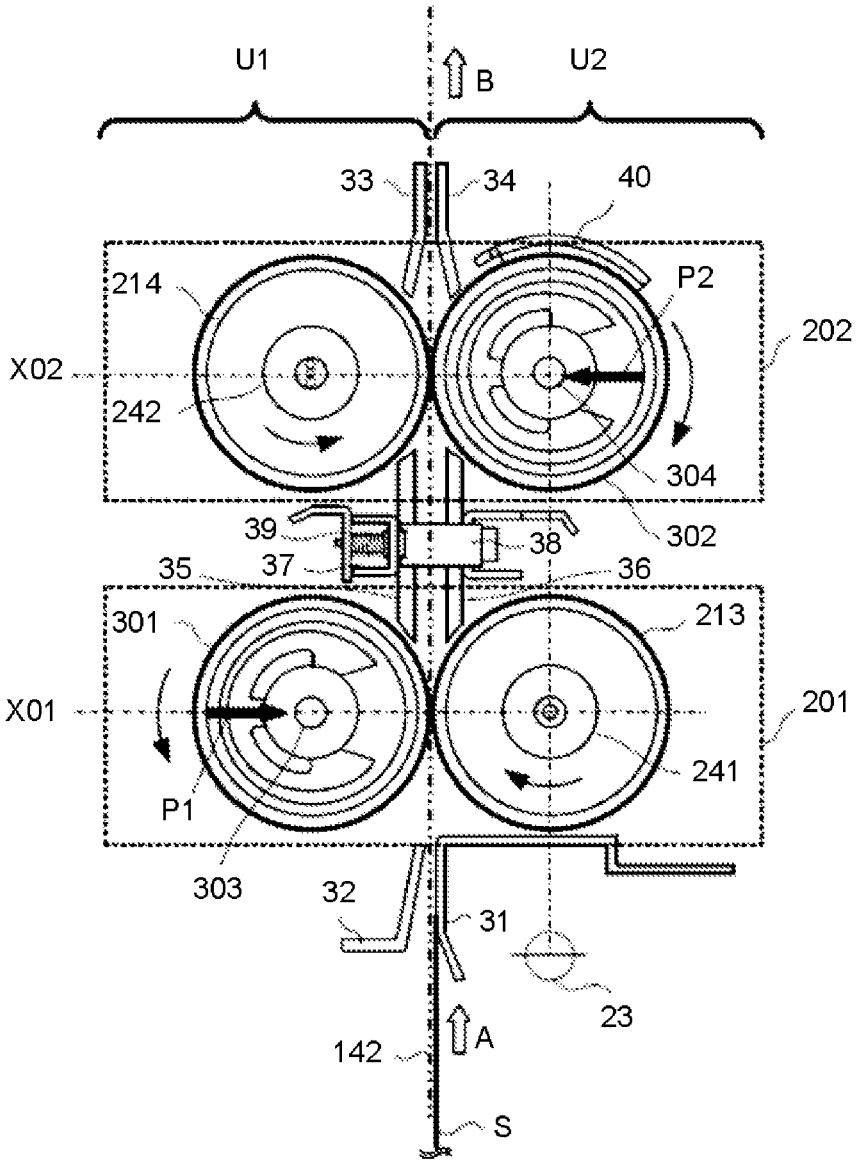
FIG. 9 is a sectional view illustrating an internal structure of a heat source unit according to an embodiment 3.

As shown in FIG. 9, the color erasing section according to the embodiment 3 is constituted by arranging the roller protection member 40 described in the embodiment 2 in the color erasing section 20 described in the embodiment 1. That is, according to the color erasing section of the embodiment 3, the inside unit and the outside unit are separated from each other with the paper conveyance path as a boundary, and as the opening angle is large, the jammed papers can be removed easily. Particularly, when paper jam occurs between the first color erasing section 201 and the second color erasing section 202, and the papers are inserted between the paper conveyance rib 35 and the first press roller 301 or the second heat roller 214, in the opened state of the color erasing section 20, the paper conveyance rib 35 moves towards the direction of the paper conveyance path, thereby pushing the jammed papers out, and the jammed papers can be removed more easily. Further, in the opened state, the protection member 40 moves to cover the exposed part of the second press roller 302 which comes close to the user, thereby preventing the hand and the like of the user from contacting with the second press roller 302 during a job of removing the jammed papers, and the jammed papers can be removed more easily.

Other Embodiments

As stated above, a color erasing section applied to a color erasing apparatus is described as an example of the heat source unit of the present embodiments, however, the present invention is not limited to this, the heat source unit may also be applied to a fixing apparatus incorporated into an image forming apparatus which uses an electrophotographic process such as a copier, a facsimile, a printer and the like. Further, as to the form of the heating member and the pressing member, in addition to the heating roller and pressing roller, it is applicable that either of the heating member and the pressing member is of a roller form, and the other one is of a belt form, alternatively, both of the heating member and the pressing member are of belt form, and the like.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A heat source unit, comprising:

a first heating section configured to include a first heating member which heats one side of a paper and a first pressing member which is arranged opposite to the first heating member across a paper conveyance path to cooperate with the first heating member to nip and convey the paper;

a second heating section, which is arranged at the downstream side of the first heating section in a paper conveyance direction, configured to include a second heating member which heats the other side of the paper and a second pressing member which is arranged opposite to the second heating member across the paper conveyance path to cooperate with the second heating member to nip and convey the paper;

a heat source opening and closing mechanism configured to include a rotation shaft at the upstream side of the first heating section in the paper conveyance direction, and be opened and closed around the rotation shaft as a boundary; and a paper conveyance guide section configured to include, between the first and the second heating sections, a first paper conveyance rib arranged at one side of the paper conveyance path and a second paper conveyance rib arranged at the other side of the paper conveyance path, at least one of which is positioned from a first position where a paper can be conveyed to a second position in which the paper conveyance rib protrudes in the direction of the paper conveyance path relative to the first position by interlocking with an operation of switching the heat source opening and closing mechanism from a closed state to an opened state.

2. The heat source unit according to claim 1, wherein the heat source opening and closing mechanism comprises a movable unit including the first heating member, the second pressing member and the second paper conveyance rib and a main body unit including the second heating member, the first pressing member, the first paper conveyance rib, and the rotation shaft, the movable unit rotating around the rotation shaft of the main body unit.

3. The heat source unit according to claim 2, wherein the first paper conveyance rib is energized to the direction of the paper conveyance path, the energization of the first paper conveyance rib is regulated by a guide rib provided in the second paper conveyance rib in a closed state, and the regulation by the guide rib provided in the second paper conveyance rib is released in an opened state.

4. The heat source unit according to claim 3, further comprising:

a protection member configured to be arranged at the second pressing member, and be positioned at a first position where a paper can be conveyed or a second position, which is different from the first position, for covering the second pressing member by interlocking with an operation of switching the heat source opening and closing mechanism from a closed state to an opened state.

5. The heat source unit according to claim 1, further comprising:

a protection member configured to be arranged at either of the second heating member and the second pressing member, and be positioned at a first position where a paper can be conveyed or a second position, which is different from the first position, for covering either of the second heating member and the second pressing member by interlocking with an operation of switching the heat source opening and closing mechanism from a closed state to an opened state.

6. The heat source unit according to claim 1, wherein the first paper conveyance rib is provided through a first rib guide and the second paper conveyance rib is provided through a second rib guide which end point thereof protrude in the direction of the paper conveyance path, the first paper conveyance rib is energized to the direction of the paper conveyance path, and the energization of the first paper conveyance rib is regulated by the contact of the first rib guide with the end point of the second rib guide in closed state.

7. A heat source unit, comprising:

a first heating section configured to include a first heating member which heats one side of a paper and a first pressing member which is arranged opposite to the first heating member across a paper conveyance path to cooperate with the first heating member to nip and convey the paper;

a second heating section, which is arranged at the downstream side of the first heating section in a paper conveyance direction, configured to include a second heating member which heats the other side of the paper and a second pressing member which is arranged opposite to the second heating member across the paper conveyance path to cooperate with the second heating member to nip and convey the paper;

a heat source opening and closing mechanism configured to include a rotation shaft at the upstream side of the first heating section in the paper conveyance direction, and be opened and closed around the rotation shaft as a boundary; and a paper conveyance guide section configured to include, between the first and the second heating sections, a first paper conveyance rib arranged at one side of the paper conveyance path, the first paper conveyance rib is positioned at a first position where a paper can be conveyed in a closed state of the heat source opening and closing mechanism, and the first paper conveyance rib is positioned at a second position in which it protrudes in the direction of the paper conveyance path relative to the first position in an opened state of the heat source opening and closing mechanism.

8. The heat source unit according to claim 7, wherein the paper conveyance guide section configured to further include a second paper conveyance rib arranged at the other side of the paper conveyance path, the second paper conveyance rib is positioned at a first position where a paper can be conveyed in a closed state of the heat source opening and closing mechanism, and the second paper conveyance rib is positioned at a second position which protrude in the direction of the paper conveyance path from the first position in a opened state of the heat source opening and closing mechanism.

9. The heat source unit according to claim 7, wherein the first paper conveyance rib is energized to the direction of the paper conveyance path, the energization of the first paper conveyance rib is regulated by a rib guide provided in the second paper conveyance rib in a closed state, and the regulation by the rib guide provided in the second paper conveyance rib is released in an opened state.

* * * * *